United States Patent [19]

Graber

[11] Patent Number: 4,905,881

[45] Date of Patent: Mar. 6, 1990

[54] BODY SAFETY WALLET

[76] Inventor: Paul J. Graber, 4050 Lankershim Blvd., North Hollywood, Calif. 91608

[21] Appl. No.: 766,151

[22] Filed: Aug. 15, 1985

[51] Int. Cl.[4] ..... A45C 13/30; A45F 3/14

[52] U.S. Cl. ..... 224/222; 224/267; 224/901; 150/131

[58] Field of Search ..... 224/222, 267, 901; 150/131, 132, 133

[56] References Cited

U.S. PATENT DOCUMENTS

| | | | |
|---|---|---|---|
| 1,728,365 | 9/1929 | Root et al. | 224/222 |
| 3,208,653 | 9/1985 | Wallace | 224/222 |
| 4,332,338 | 6/1982 | Christiansen | 224/222 |

*Primary Examiner*—Henry J. Recla

*Attorney, Agent, or Firm*—Jessup, Beecher & Slehofer

[57] ABSTRACT

A body wallet is adapted to be worn around the ankle region by encircling it. It is large enough to hold an unfolded conventional-sized wallet. The wallet is made of a cloth material having an interior pouch and two strips of hook and loop fastening material sewn along each of the transverse ends. The pouch has a lengthwise opening for receiving articles. The wallet is large enough to encircle a limb with the ends overlapping somewhat. The two strips of hook and loop fastening material, otherwise known as VELCRO strips, are then engaged to keep the wallet in place. There is an elastic safety belt and buckle extending from and attached to the transverse ends. They are coupled to act as a safety backup when the VELCRO strips become loose. The pouch includes interior pockets or compartments for holding articles and there can be an outside pocket for holding articles such as coins or keys which are accessible without undoing the wallet.

10 Claims, 1 Drawing Sheet

BODY SAFETY WALLET

BACKGROUND OF THE INVENTION

1. Field of the Invention:

The present invention pertains to purses, wallets, covers & cases, and more particularly to a wallet being loss resistant, and with means to deter theft of contents.

2. Description of the Prior Art:

A typical body wallet is attachable to any limb of the body such as the upper arm, the wrist, the thigh or the ankle region of the user. These body wallets are of a flexible construction so that they can girth the respective limb and are secured at the ends to prevent the wallet from becoming detached and lost. The securing means to maintain the wallet to the limb is usually an elastic strap and buckle combination, a stretchable fabric comprising the wallet body or a traditional belt and buckle having a series of adjustment holes in the belt portion.

SUMMARY OF THE INVENTION

The body wallet has general overall dimensions of 14" length by 4" width. The material which forms the walls of the wallet is cut from a sheet of canvas having overall general dimensions of 14" by 8". The sheet can be folded lengthwise to form the two walls, or sides, of the wallet and the two transverse ends are sewn shut. An alternative method of construction would be to have two sheets of 14" by 4" superposed on each other and having the two transverse ends and lengthwise bottom sewn shut to fabricate a wallet having one large compartment, or pouch.

There are two strips of material known by the trademark VELCRO. One strip is the hook fastener material and the other strip is the loop fastener material. The loop strip is attached parallel to and along the length of one transverse end and the hook strip is attached parallel to and along the other transverse end. Both strips form the end flaps of the wallet.

The wallet can be fitted to the lower leg of the user by having the wallet snugly wrapped around the lower leg and then engaging the hook and loop fasteners to hold the wallet in place. The hook and loop strips, or end flaps, are sufficiently wide enough to overlap each other somewhat. This feature accommodates various limb girths.

An additional backup safety feature is provided in case the hook and loop strips become disengaged. There is an elastic band, or belt, sewn midway and extending longitudinally from one transverse end of the wallet. A buckle is sewn to the other side end. After the hook and loops are engaged, the elastic belt is coupled with the buckle in a stretched fashion. The tension maintained by the elastic band helps to keep the wallet from slipping while walking, and it also prevents the wallet from falling off the leg and becoming lost should the VELCRO strips come loose.

The lengthwise opening along the longitudinal edge for receiving articles into the pouch can be left open or can be sealed by a flap, a matching pair of VELCRO strips, or a zipper. The interior compartment is large enough to accommodate a conventional wallet in the folded or unfolded position. When the conventional wallet is inserted in the unfolded position, it makes for a more comfortable fit by eliminating the bulge which would be present if inserted into the pouch in the folded position. The interior walls of the wall can have pockets sewn to them for holding and segregating various articles. There can be four interior pockets having dimensions of 2½" wide by 4" deep. These pockets form sections for holding a person's I.D., credit cards, cash and the like. There can be one or more exterior pockets sewn to the outside wall of the wallet for holding articles which are frequently needed such as coins, keys, or the like. The wallet does not have to be removed to gain access to the outside pocket. The outside pocket could have a snapped flap to secure the contents therein.

In another embodiment of the wallet, there are three identically cut sheets of canvas which are superposed on one another. The resulting transverse ends and one longitudinal end are sewn shut to form a wallet having two compartments having the same dimensions as that of the resulting wallet.

It is to be understood that the wallet is not to be limited in size or placement on the body. The overall dimensions of the wallet could be reduced to be adaptable to the wrist, or the dimensions could be increased to be adaptable to the thigh. The wallet could be worn on the upper arm much as an arm band would be worn. The main purpose of the wallet would be for security reasons. A person's valuables could be placed in the wallet and worn around the region of the ankle. Placement of the wallet around the ankle region could frustrate would-be-pickpockets and would probably foil a robbery attempt in that the felon might frisk only the torso of the intended victim looking for a wallet without patting down the lower legs. Loose fitting pants would conceal the wallet. Bulky socks could also be worn to conceal the wallet.

The body wallet could be used in the same way as one uses a standard hip wallet. The interior pockets hold the same items that are carried in a standard hip wallet. The body wallet offers an additional feature. The wallet can also function as a carrier for the wearer's existing conventional wallet. The empty body wallet can be worn about the ankle region and for security reasons, when the wearer is in unsafe environs, he can insert the unfolded conventional wallet containing his valuables into the body wallet holder and refit it to his leg. The security wallet would be useful to tourists travelling in foreign countries.

The body wallet is an improvement over the standard hip or breast wallet because it offers the wearer greater security from a lost, misplaced, or stolen wallet. The body wallet is physically attached to the person at all times unlike a standard wallet, which can be left behind in a jacket or an automobile. The body wallet affords more comfort to the hip wallet user because the discomfort of sitting on the hip wallet is eliminated. The body wallet improves one's dress appearance by eliminating unsightly bulges in the worn jacket or pants.

The body or ankle wallet offers the wearer a method of carrying a wallet on their person while in attire such as jogging outfits or beach outfits which do not have pockets for carrying wallets.

The body wallet/ holder can also carry a weapon such as a small pistol for self protection in areas where it is not illegal to do so. The interior pockets could hold extra bullets.

The body wallet could also be outfitted with items for emergency use such as a snakebite kit, fishing line and hooks, and the like.

BRIEF DESCRIPTION OF THE DRAWINGS

A first embodiment will now be described.

DETAILED DESCRIPTION OF THE FIRST EMBODIMENT

Figure 1:
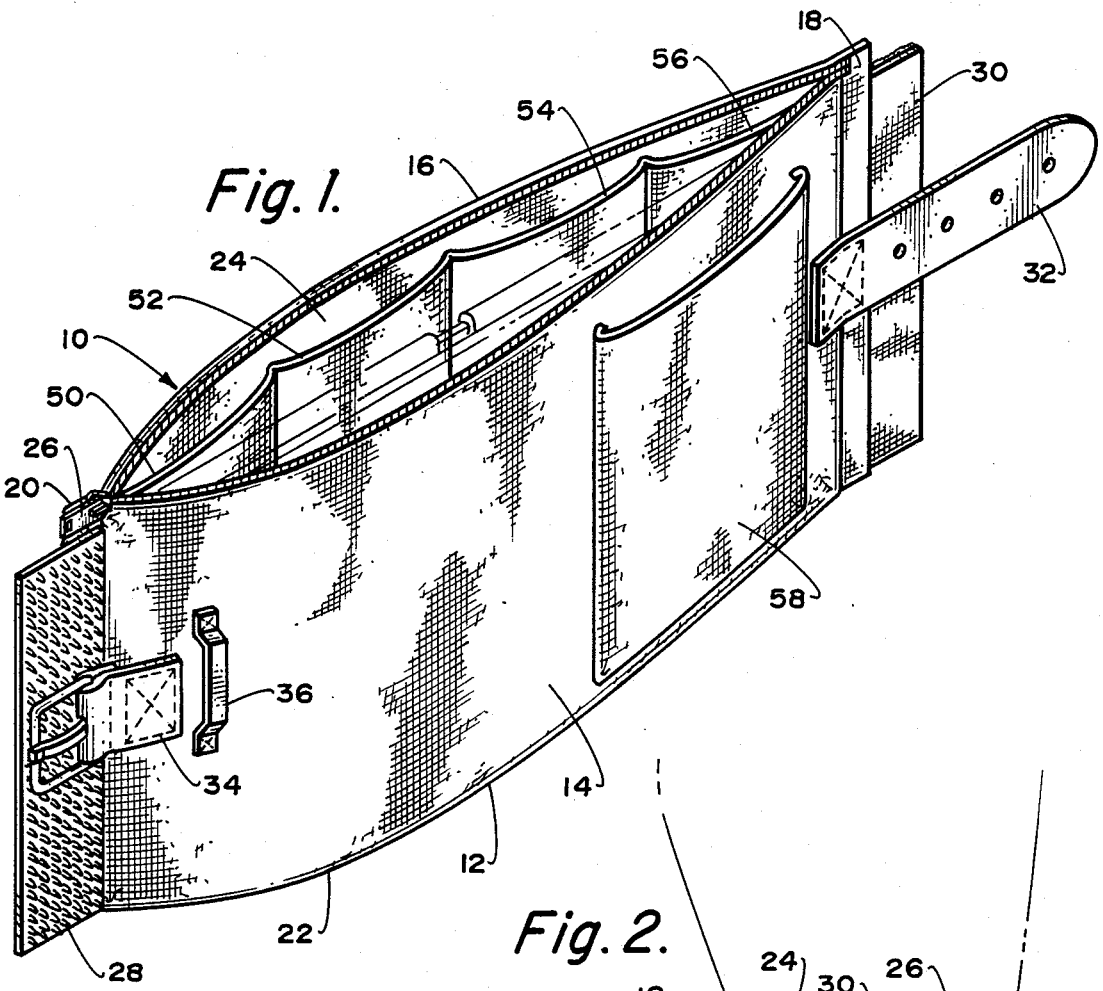
FIG. 1 is a perspective view of the wallet showing the pouch open with a conventional-sized wallet inserted therein.

In the figures, FIG. 1 discloses a perspective view of the body wallet in an open position showing a conventional-size wallet unfolded and placed within the pouch 10 of the wallet. The wallet, and therefore the pouch, is formed by at least one sheet means of generally rectangular material folded back upon itself. The sheet means is illustrated as a piece of flexible fabric such as canvas, or nylon, having overall general dimensions of 14"×8". As disclosed in FIG. 1, the sheet is folded lengthwise to form a front wall 14 and a back wall 16 which form the two sides of the wallet. When the sheet 12 is folded in this position, two transverse ends 18 and 20 are formed. A bottom longitudinal end 22 is formed and a top longitudinal end 24 is also formed. The two transverse ends 18 and 20 have a means for sealing them which are illustrated as a thread sewing shut both ends to form the pouch 10. The top longitudinal opening 24 into the pouch has a zipper 26 to close and seal the contents placed within the pouch 10.

There is a 3" wide strip of hook fastener material 28 attached near and extending from the transverse end 20. The length of the hook fastener material is generally of the same length as the transverse end. About one-half the width of the hook material overlaps onto the front wall 14. The hooks face away from the front wall 14.

The other transverse end 18 of the wallet has a strip of 2" wide loop fastener material 30 attached thereto. The length of the loop fastener material is generally the same as the length of the transverse end 18. The width of the loop fastener material 30 is wide enough to have part of the end attached by being sewn with thread to the back wall 16 of the wallet. The loop material faces away from the back wall of the wallet. The matching pair of strips of hook and loop fastener material 28 and 30 are sold under, and commonly referred to by the trademark VELCRO. The two matching VELCRO strips are pressed together after the wallet is fitted about the ankle region of the user. The VELCRO strips are adherent to one another and are intended to hold the wallet in place.

Also attached to each of the transverse ends is a safety belt and buckle combination means, illustrated as an elastic band 32 and buckle 34; the band, or belt, being sewn medially and extending longitudinally from the transverse end 18 of the wallet. The belt can be made from an elastic material about 1" in length, a strip of plastic, or leather and has a plurality of holes for engaging a buckle 34, which is attached medially and extends longitudinally from the other transverse end 20 of the wallet. It is not essential that the belt and buckle be attached to the medial portions of the transverse ends. They could be attached at the corner areas of the transverse ends, and would function in the same manner. There is an optional loop 36 for holding the end of the belt 32 and keeping it in place.

The zipper shown in FIG. 1 is about 10" long and is merely to illustrate a means for opening and closing the longitudinal open end of the pouch for securing the contents within the pouch along the top longitudinal end 24 of the wallet. The pouch could be left open or it could be sealed by a flap, a matching pair of VELCRO strips or a zipper as illustrated and described.

The interior compartment of the pouch 10 is of sufficient dimensions to accommodate a conventional-size wallet shown in phantom lines in the open, or unfolded position. A conventional- size wallet has the general overall dimensions of 9"×4". Alternatively, the conventional, or standard-size wallet could be inserted in the folded position. However, it makes for a more comfortable fit in the unfolded position by eliminating the bulge which would be present if inserted in the folded position.

The two walls 14 and 16 of the wallet also form interior walls. There can be at least one interior pocket means inside of the pouch for holding articles. The interior pocket means is illustrated as four interior pockets 50, 52, 54 and 56, attached to the inside of wall 16 of the wallet. These interior pockets can be fabricated by taking a strip of material 10"×4" and sewing the sides and bottom and three equally spaced vertical thread lines for creating these four pockets. The purpose of these 2½"×4" interior pockets is for holding and segregating various articles such as credit cards, cash, coins, keys, valuable papers, driver's licenses and the like.

There can be at least one exterior pocket means on the outside of the pouch forming the wallet for holding articles or personal effects. Illustrated is one such exterior pocket 58 sewn on the outside of wall 14 of the wallet. This outside pocket 58 has dimensions generally of 3½"×4". It is formed by a piece of canvas fabric. This outside pocket is large enough to accommodate a conventional-sized wallet in the folded position.

SECOND AND THIRD EMBODIMENTS

In the first embodiment above, a single sheet of canvas fabric having the overall dimensions of 8"×14" was folded back upon itself longitudinally to form the two side walls forming the wallet. If desired, however, two pieces of canvas material of 4"×14" overall dimensions could be sewn along the two transverse ends and along the bottom end for forming the two walls of the wallet. For ease in manufacturing of the wallet, it may be more efficient to take the separate sheets of fabric to sew the appropriate interior pockets, the respective zippers, the outside pocket, the matching pair of VELCRO strips and the safety belt and buckle features to the two sheets before sewing them together to form the finished product.

In a third embodiment not illustrated, three sheets each of 4"×14" canvas material could be superposed and sewn along the two transverse ends and the bottom longitudinal end for forming two side by side, or medial compartments each having the overall dimensions of the wallet. Again, if desired, interior pockets could be sewn to any of the faces of the compartment or the interior walls of the wallet for the additional convenience of segregating various articles for the convenience of the user.

It is to be understood that the wallet is not to be limited to the size described nor to the placement of the wallet around the ankle area. The overall dimensions of the wallet could be reduced to be adaptable to the wrist, or the dimensions could be increased to be adaptable to the thigh. The wallet could be worn on the upper arm much as an arm band would be worn.

OPERATION OF THE EMBODIMENTS

Figure 2:
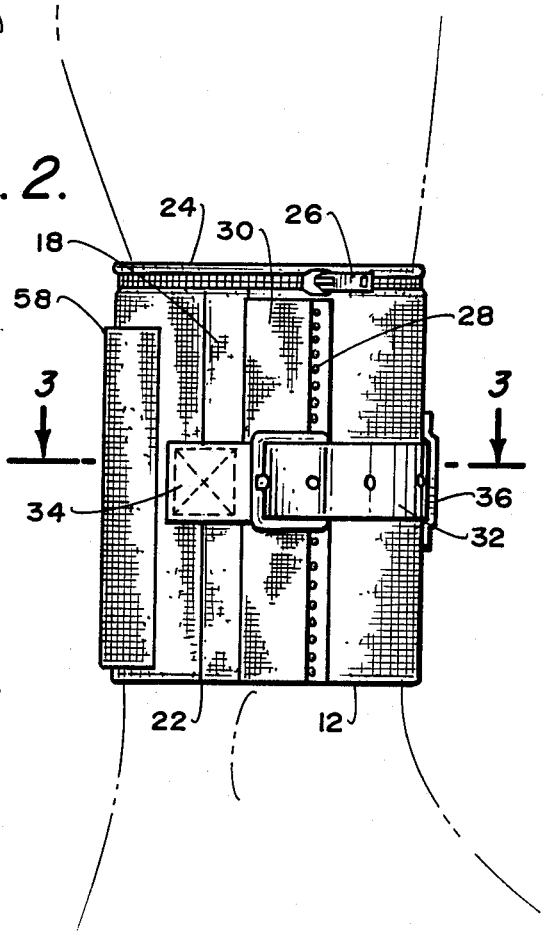
FIG. 2 illustrates the body wallet correctly positioned on the ankle of the user with the hook and loop fastening strips engaged and the elastic belt and buckle coupled.
Figure 3:
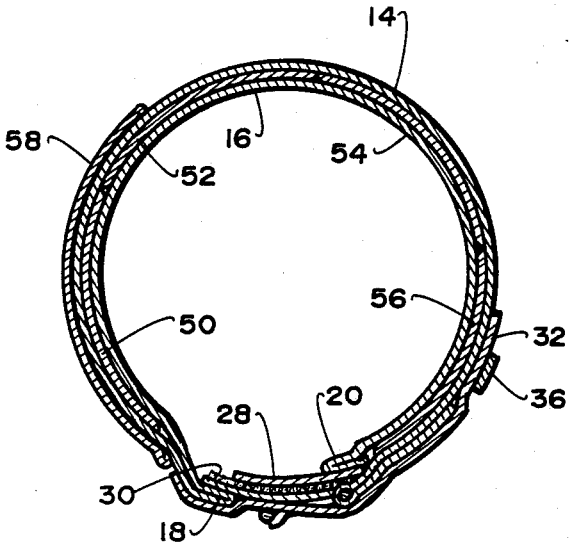
FIG. 3 is a transverse cross-sectional view taken along the lines 3—3 of FIG. 2 illustrating how the wallet fits around the region of the ankle.

Referring now to FIG. 2 and 3, there is illustrated a correct positioning of the wallet to the body. FIG. 2 illustrates the ankle region of the user in phantom lines and having the wallet wrapped transversely around the girth of the ankle region. The wallet is conformable about the arm or leg of the user and the matching strips of hook and loop fasteners are adherent to each other when pressed together for holding the wallet in position. As is illustrated in FIG. 2, the matching pair of VELCRO strips 28 and 30 are engaging each other, and the safety belt 32 and buckle 34 are buckled together. This safety belt and buckle will prevent the wallet from disengaging from the user's leg should the hook and loop fastener material become undone. The zipper 26 is also in its closed position.

As can be seen in FIG. 2, the Velcro strips have widths of approximately 2" each which provides for a certain amount of the overlapping of the body wallet around the ankle region of the user. These widths are to insure good contact and adhesion between the matching VELCRO strips to minimize the risk of having the strips coming loose while walking with the wallet on. The widths are also to accommodate various size ankle circumferences. By utilizing this extra width of both of the velcro strips, one size wallet will fit nearly every user's ankle.

FIG. 3 is a cross-sectional view taken along the lines 3—3 of FIG. 2 illustrating the overlap of the VELCRO strips and how the body wallet conforms to the girth of the ankle.

Obviously, many modifications and variations are possible in light of the above teachings. It is therefore to be understood that the full scope of the invention is not limited to the details disclosed herein and may be practiced otherwise than as specifically described.

What is claimed is:

1. A body wallet comprising:

at least one sheet means of generally rectangular material folded back upon itself for forming two transverse ends and a lengthwise opening along one longitudinal end;

means for sealing each said transverse end for forming a wallet;

a relatively wide strip of hook fastener material attached transversely along one said transverse end;

a relatively wide strip of loop fastener material attached transversely along said other transverse end, said wallet being conformable about the limb of a wearer and said strips of hook and loop fasteners overlapping and facing each other and being releasably adherent to each other when pressed together for holding the wallet in place on the wearer;

said relatively wide strips of hook and loop fastener materials being sufficiently overlapping for compensating for variances in a wearer's limb circumference and for compensating for various sized items carried in said wallet;

safety belt and buckle combination means attached to either end of said transverse ends for preventing the wallet from disengaging from the wearer's limb should said hook and loop fastener material become disengaged.

2. The wallet as recited in claim 1 further comprising:

means for opening and closing said longitudinal open end of said wallet for securing the contents within said wallet.

3. The wallet as recited in claim 2 wherein said opening and closing means includes a zipper, a flap or a hook and loop fastener combination.

4. The wallet as recited in claim 3 further comprising:

at least one interior pocket means inside said wallet for holding articles.

5. The wallet as recited in claim 3 further comprising:

at least one exterior pocket means on the outside of said wallet for holding articles.

6. The wallet as recited in claim 2 wherein said wallet is sufficiently large to contain a conventional-sized wallet.

7. The wallet as recited in claim 2 wherein said sheet means is comprised of a flexible fabric such as canvas or nylon.

8. A body wallet comprising:

a first sheet of generally rectangular material;

a second sheet of generally rectangular material being generally of the same size as said first sheet and being superposed on said first sheet thereby forming two transverse ends and two longitudinal ends;

means for sealing said two transverse ends and one longitudinal end thereby forming a compartment;

a relatively wide looped VELCRO strip attached along one said transverse end;

a relatively wide hooked VELCRO strip attached along said other transverse end;

said wallet being wrapped about the circumference of a user's limb and said VELCRO strips facing each other and being overlapping and releasably adherent to each other when pressed together for holding said wallet in place on the wearer's limb;

said relatively wide strips of VELCRO being sufficiently overlapping to compensate for variances in a wearer's limb circumference and for compensating for various sized items carried in said wallet;

an elastic strap attached generally medially and extending from one said transverse end adjacent to one of said VELCRO strips;

buckle means attached generally medially and extending from said other transverse end for engaging said elastic strap for providing a safety means for preventing said wallet from being lost should said VELCRO strips become disengaged;

a zipper attached along said unsealed longitudinal end.

9. The body wallet as recited in claim 8 further comprising:

a third sheet of generally rectangular material being generally of the same size as said first and second sheets and being superposed on said first and second sheets thereby forming two transverse ends and two longitudinal ends;

means for sealing said two transverse ends and one longitudinal end thereby forming two medial compartments.

10. A body wallet comprising:

at least one sheet means of generally rectangular material folded back upon itself for forming two transverse ends and a lengthwise opening along one longitudinal end;

means for sealing each said transverse end for forming a wallet;

a relatively wide strip of hook fastener material attached transversely along one said transverse end;

a relatively wide strip of loop fastener material attached transversely along said other transverse end, said wallet being comformable about the limb of a wearer and said strips of hook and loop fasteners overlapping and facing each other and being releasably adherent to each other when pressed together for holding said wallet in place on the wearer;

said relatively wide strips of hook and loop fastener materials being sufficiently overlapping for compensating for variances in a wearer's limb circumference and for compensating for various sized items carried in said wallet;

safety belt and buckle combination means attached generally medially and extending from either end of said transverse ends for preventing said wallet from disengaging from the wearer's limb should said hook and loop fastener material become disengaged;

means for opening and closing said longitudinal open end of said wallet for securing the contents within said wallet.

* * * * *